United States Patent [19]

Wirsbinski

[11] 4,383,381

[45] May 17, 1983

[54] DOZER BLADE MOUNTING ARRANGEMENT

[75] Inventor: James L. Wirsbinski, Marshfield, Wis.

[73] Assignee: J. I. Case Company, Racine, Wis.

[21] Appl. No.: 281,986

[22] Filed: Jul. 10, 1981

[51] Int. Cl.[3] ..... E01H 5/06

[52] U.S. Cl. ..... 37/283

[58] Field of Search ..... 37/41, 42 R, 42 VL, 37/44, 46, 50, 283; 172/818–823

[56] References Cited

U.S. PATENT DOCUMENTS

| | | | |
|---|---|---|---|
| 2,792,650 | 5/1957 | Kenyon | 172/819 X |
| 2,854,766 | 10/1958 | Miller | 172/818 X |
| 3,353,287 | 11/1967 | King | 37/50 X |
| 3,355,825 | 12/1967 | Weeks | 37/42 R |
| 3,422,553 | 1/1969 | Holloway | 37/50 |
| 3,464,129 | 9/1969 | Bogenschutz | 172/819 X |
| 4,215,494 | 8/1980 | Farrell et al. | 172/42 R |

*Primary Examiner*—E. H. Eickholt

*Attorney, Agent, or Firm*—Dressler, Goldsmith, Shore, Sutker & Milnamow, Ltd.

[57] ABSTRACT

An improved front blade mounting arrangement for a tractor is disclosed which includes a blade assembly supported by a blade mount for pivoting movement of the blade assembly to change its working angle. A control arm extending from the blade mount to the control area of the tractor permits the operator to raise and lower the blade mount and blade assembly in unison. A self-actuating lock mechanism is provided for locking the blade assembly at the desired angle when the blade assembly and blade mount are in the lowered position, the lock mechanism including a pivotal lock bar which is substantially disengaged from the blade assembly when it is in the raised position so that the tractor operator may conveniently angularly reposition the blade assembly without leaving the operator's control area on the tractor.

12 Claims, 5 Drawing Figures

DOZER BLADE MOUNTING ARRANGEMENT

FIELD OF THE INVENTION

The present invention pertains generally to front dozer blade mounting arrangements for tractors, and more particularly to an improved front blade mounting arrangement which accommodates angular repositioning of the blade when it is maintained in a raised position by the mounting arrangement.

BACKGROUND OF THE INVENTION

At one time, the use of tractors was typically associated with agricultural and construction operations. Today, however, tractors are available in a very wide variety of sizes and models, and smaller sized units have become particularly popular for home, garden and lawn use, as well as for other relatively light duty operations.

As with other equipment, the versatility of a tractor unit enhances its value, and to this end many units are adapted to be fitted with a variety of attachments for performing different work operations. One such attachment commonly used is a front-mounted dozer blade, or blade, used for moving earth, gravel, snow, and the like.

Front blade attachments of this nature typically include a frame support which is mounted to the tractor frame or otherwise attached to the tractor unit, and pivotally supports a blade mount and blade assembly. A control linkage extending from the blade mount to the operator's control area pivots the blade mount with respect to the frame support so that the blade assembly may be raised and lowered with respect to the ground.

Blade attachments of this nature may also include an arrangement whereby the angle of the blade with respect to the longitudinal centerline of the tractor may be altered. This is typically provided by pivotally mounting the blade assembly to the blade mount so that the angle of the blade assembly may be altered with respect to the mount. A removable locking pin extends through the blade mount and the blade assembly to maintain the blade assembly in the selected attitude.

One drawback of arrangements of this nature is the necessity of the tractor operator leaving the control area of the tractor in order to alter the angle of the blade assembly since the removable locking pin is only accessible from the front of the tractor. Thus, an arrangement whereby the angle of the blade assembly could be easily altered by the tractor operator from the control area would add convenience to the use of such a blade attachment, and would reduce the time required for performing a work operation where changes in blade angle are needed or desired.

SUMMARY OF THE INVENTION

In accordance with the present invention, a blade mounting arrangement for a tractor is provided which accommodates ready alteration of the blade angle from the control area when the blade is in a raised position, and maintains the blade at the selected angle when it is in the lowered position.

The blade mounting arrangement includes a frame support adapted to be fixedly mounted on the tractor. A blade mount is pivotally supported by the frame support for movement about a horizontal axis between raised and lowered positions, and means are provided for moving the blade mount between these positions.

A dozer blade assembly is supported by and movable with the blade mount, the blade assembly being pivotally connected to the mount for movement about a blade axis which is generally vertically disposed when the blade mount is in the lower position. A blade lock arrangement is provided for preventing movement of the blade assembly about the blade axis when the blade mount is in the lowered position, and allows movement of the blade assembly about the blade axis when the blade mount is in the raised position.

The blade lock arrangement includes a lock bar which is movably, and preferably pivotally, mounted on the blade mount and is movable into and out of engagement with the blade assembly. A link is provided extending between and respectively connected with the lock bar and the frame support of the mounting arrangement. In this way, movement of the blade mount between the raised and lowered position moves the lock bar into and substantially out of engagement with the blade assembly. A spring is provided for biasing the lock bar toward engagement with the blade assembly, and assures proper engagement of the lock bar with the assembly.

In order to prevent the blade assembly from freely moving with respect to the blade mount when the mount is in the raised position, projections are provided on the blade assembly for engagement with the lock bar mounted on the blade mount. When the blade mount is in the lowered position, the lock bar positively engages these projections to prevent the blade from changing angle with respect to the blade mount. When the blade mount is moved to the raised position, the lock bar is substantially disengaged from the projections on the blade assembly, but not so much as to allow the blade assembly to pivot freely about the blade axis. The projections are provided with cam portions which engage the lock bar when the blade mount is in the raised position, the cam portions urging or camming the lock bar out of engagement with the projections when the blade assembly is pivoted about the blade axis by the tractor operator through a blade pivot arm extending from the blade assembly to the control area. Thus, changes in the angle of the blade are easily made when it is in the raised position, but totally free movement of the blade is avoided. Stops are also provided on the blade assembly to prevent the blade assembly from being moved such that it might inadvertantly contact or hit the tractor unit.

DESCRIPTION OF THE PREFERRED EMBODIMENT

Figure 1:
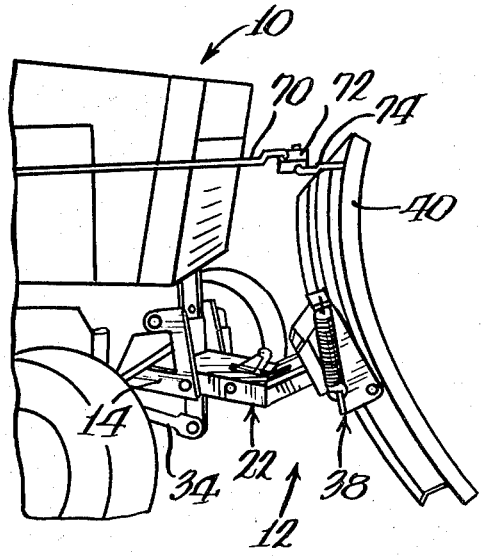
FIG. 1 is a partial perspective view of a tractor including the front blade mounting arrangement of the present invention.

While the present invention is susceptible to embodiment in different forms, there is shown in the drawings and will hereinafter be described a presently preferred embodiment with the understanding that the present disclosure is to be considered as an exemplification of the invention and is not intended to limit the invention to the specific embodiment illustrated.

Figure 2:
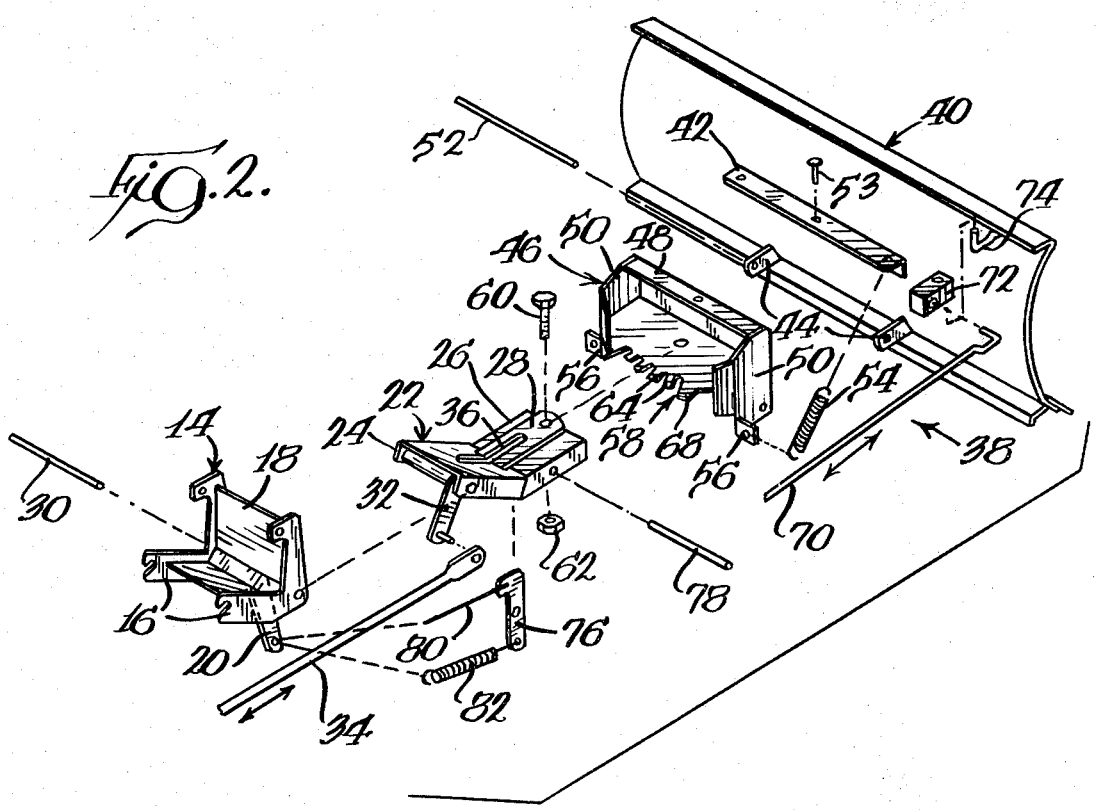
FIG. 2 is an exploded perspective view of the blade mounting arrangement shown in FIG. 1.

With reference now to FIGS. 1 and 2, therein is illustrated a tractor unit 10 to which is attached the front dozer blade mounting arrangement 12 of the present invention. The blade mounting arrangement 12 includes a frame support 14 which is adapted to be fixedly connected to the frame or other similar portion of the tractor 10. Frame support 14 includes a pair of laterally spaced support members 16 which are joined by a support web 18 extending therebetween. A support arm 20 depends from support web 18 of frame support 14, and provides an anchor for a link to the lock mechanism of the arrangement, as will be described.

Blade mounting arrangement 12 further includes a blade mount 22 which is supported by frame support 14. Blade mount 22 includes a rear channel portion 24 which is joined at an angle to a front channel portion 26. A top flange 28 is fixed to rear channel portion 24, and extends therefrom in spaced, generally parallel, overlapping relation to front channel portion 26. A mount pivot pin 30 extends through support members 16 of frame support 14 and the rear channel portion 24 of blade mount 22 whereby the blade mount 22 is pivotally supported by frame support 14 for movement about a generally horizontal axis. A mount lever 32 depends from and is affixed to the rear channel portion 24 of blade mount 22, and is adapted to pivotally receive a mount pivot arm 34 which extends rearwardly of the blade mount 22 to the control area of the tractor 10 so that pushing or pulling pivot arm 34 respectively raises and lowers blade mount 22 by pivoting it about mount pivot pin 30 to move blade mount 22 between raised and lowered positions. Blade mount 22 defines a centrally disposed mount slot 36 which accommodates positioning of the blade lock mechanism in accordance with the present invention.

With further reference to FIG. 2, blade mounting arrangement 12 further includes a blade assembly 38. Assembly 38 includes a dozer blade 40 having an upper attachment flange 42 and lower attachment flanges 44. Flange 42 and flanges 44 accommodate attachment of blade 40 to blade support 46 of the blade assembly 38. The blade support 46 includes an upper flange 48 and a pair of laterally spaced side plates 50 to which the blade 40 is connected. A generally horizontally disposed blade pin 52 extends through lower attachment flanges 44 of blade 40 and through side plates 50 of the blade support 46, thus providing partial attachment of the blade 40 to the blade support 46.

Further attachment of blade 40 to blade support 46 is provided by a flange pin 53 which extends through suitable centrally disposed holes defined by upper attachment flange 42 of blade 40 and upper flange 48 of blade support 46. Attachment of blade 40 and blade support 46 is further provided by a pair of blade springs 54 (one being shown) which extend between side tabs 56 extending outwardly of side plates 50 of blade support 46, and respective ends of upper attachment flange 42 of blade 40. It will be appreciated by those familiar with the art that this type of attachment arrangement provides some flexibility for the blade 40 so that undue stress is not put upon the mounting arrangement during use.

In order to mount the blade assembly 38 to blade mount 22 for support of the assembly, the blade support 46 includes a generally laterally extending blade support plate 58. Blade support plate 58 is adapted to be interposed and fit between front channel portion 26 and top flange 28 of blade mount 22 in sandwich-like relation. A pivot bolt 60 extends through top flange 28, blade support plate 58, and front channel portion 26 so that the blade assembly 38 may pivot with respect to blade mount 22 about a blade axis defined by pivot bolt 60. A pivot nut 62 maintains pivot bolt 60 in position thus connecting the blade assembly 38 to the blade mount 22. It will be noted that the blade pivot axis is generally vertically disposed when blade mount 22 is in the lowered position (see FIG. 3). Thus, the blade assembly 38 is maintained in position by blade mount 22, but may be pivoted about the blade axis for altering the working angle of the blade assembly 38 including blade 40.

Figure 5:
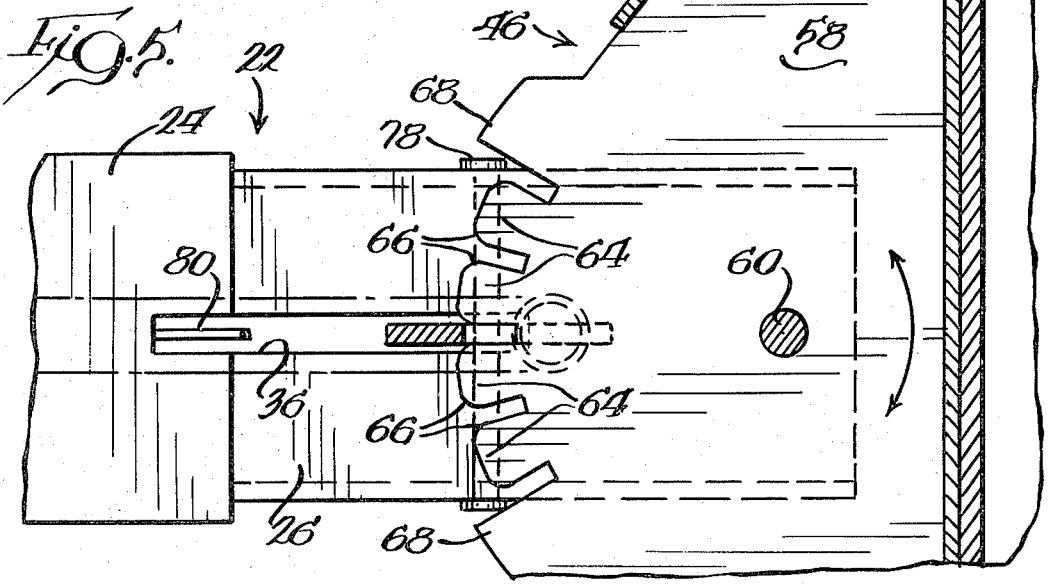
FIG. 5 is a view taken generally along lines 5—5 of FIG. 4.

In order to accommodate repositioning of the blade assembly 38 with respect to blade mount 22 for changing the working angle of blade 40, blade support plate 58 of blade support 46 includes a plurality of central projections 64. As best shown in FIG. 5, projections 64 extend generally rearwardly of blade support plate 58, and define slots therebetween. Each of the projections 64 include outer edge cam portions 66 which act as cams during the operation of the blade lock mechanism. The blade support plate 58 further includes stops 68 on respective opposite sides of the projections 64 which limit the pivoting action of blade assembly 38 about pivot bolt 60. Stops 68 prevent the blade assembly 38 from inadvertently knocking or contacting the tractor 10 when the blade assembly 38 is pivoted to one side or the other.

Changing of the angle of the blade assembly 38 from the operator's position on the tractor 10 is provided by a blade pivot arm 70 which extends rearwardly from blade 40 to the control area. Pivot arm 70 includes an end portion which is received within a pivot block 72, block 72 being mounted on arm 74 which extends rearwardly from blade 40. Thus, pulling or pushing of pivot arm 70 by the tractor operator acts to pivot blade assembly 38 between top flange 28 and channel portion 26 of blade mount 22 about the blade axis defined by pivot bolt 60.

Figure 3:
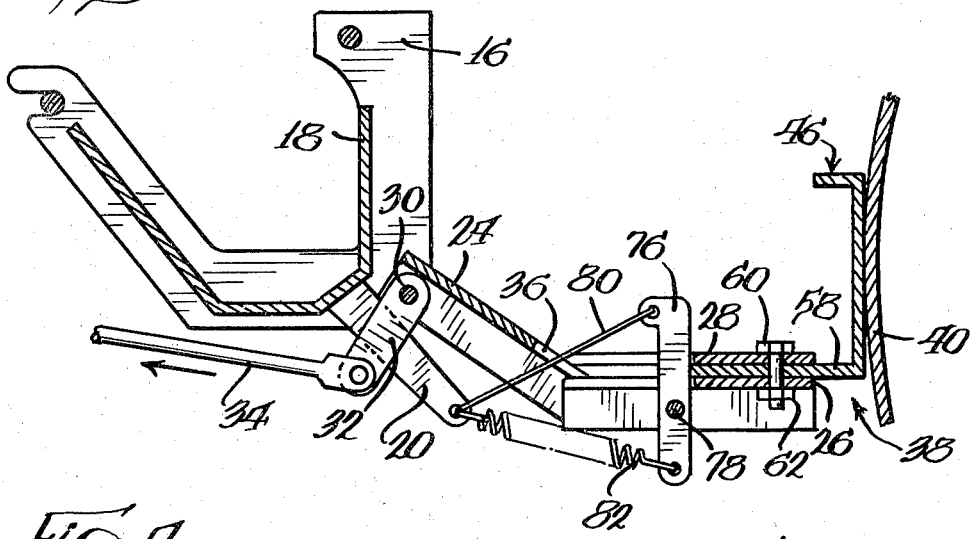
FIG. 3 is a side elevational view in cross-section of the blade mounting arrangement shown in FIG. 1 in a lowered position.

In order to allow pivoting of the blade assembly 38 with respect to blade mount 22 only when desired, a blade lock mechanism is provided in accordance with the subject invention. The lock mechanism includes a lock bar 76 which is pivotally mounted intermediate its ends to front channel portion 26 of blade mount 22 by lock bar pivot 78 for movement about a generally horizontal axis. As shown in FIGS. 3 and 5, lock bar 76 is disposed such that it extends through mount slot 36 defined by blade mount 22.

As further described below, lock bar 76 is adapted to engage at least one of projections 64 on blade support plate 58 of blade support 46 to prevent pivoting of blade assembly 38 with respect to blade mount 22 when blade mount 22 is in the lowered position.

Figure 4:
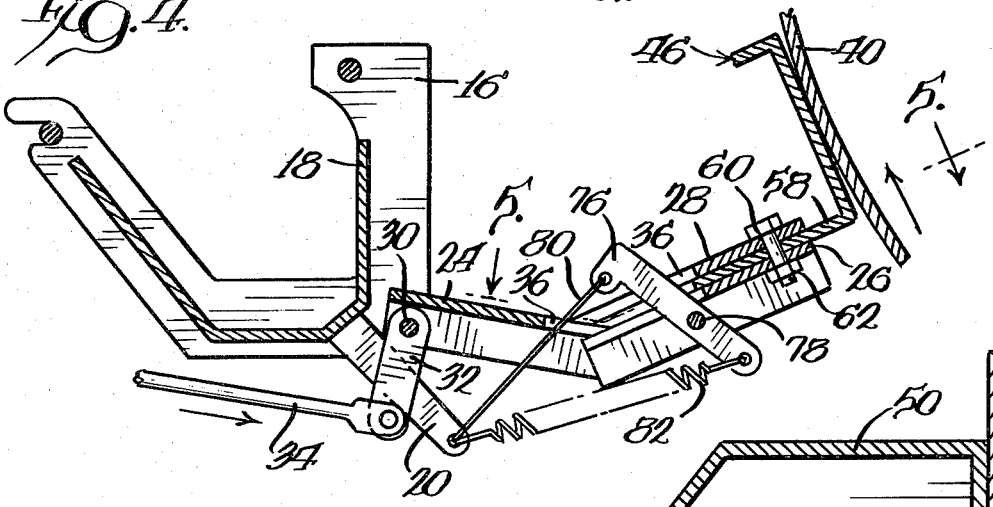
FIG. 4 is a side elevational view in cross-section of the blade mounting arrangement shown in FIG. 1 in the raised position.

With reference to FIGS. 2, 3 and 4, the first and second upper and lower ends of lock bar 76 are respectively connected with support arm 20 depending from support web 18 of frame support 14 by a lock bar link 80 and a lock spring 82. As described below, this arrangement of elements acts to "automatically" substantially disengage lock bar 76 from blade support plate 58 of blade support 46 to accommodate angular repositioning of the blade assembly 38 when in the raised position.

OPERATION

As shown in FIG. 3, blade mounting arrangement 12 of the present invention is disposed in a lowered position for use. In this position, lock bar 76 is urged by lock spring 82 and lock bar link 80 into engagement with projections 64 provided on blade support plate 58 of blade support 46 of blade assembly 38. Lock bar 76 is disposed in one of the slots defined by projections 64, and positively locks blade assembly 38 in position with respect to blade mount 22. Thus, the working angle of blade 40 is fixed with respect to tractor 10, and the tractor's operator may use the blade in a normal fashion.

When the tractor operator desires to reposition blade assembly 38 so as to alter its working angle with respect to tractor 10, the novel blade mounting arrangement of the present invention obviates the need for the operator to leave the control area and reposition the blade assembly as has been typically the case with designs heretofore known. Instead, the operator pushes on mount pivot arm 34 so that blade mount 22 and blade assembly 38 are pivoted about mount pivot pin 30 and are moved to a raised position. As this occurs, tension is created in lock bar link 80 which causes lock bar 76 to pivot about lock bar pivot 78 in opposition to the force of lock spring 82. FIGS. 4 and 5 illustrate the position of lock bar 76 when blade mount 22 and blade assembly 38 are in the raised position. In this position, lock bar 76 is substantially disengaged from projections 64 on blade support plate 58. It will be noted, that lock bar 76 still engages cam portions 66 of projections 64. By providing this partial engagement of lock bar 76 with projections 64, blade assembly 38 is prevented from freely pivoting with respect to blade mount 22 about pivot bolt 60. Thus, blade assembly 38 is maintained at the angle previously selected even when the blade mount 22 and blade assembly 38 are moved to the raised position.

If the tractor operator wishes to change the angle of the blade assembly 38, he may do so by pushing or pulling on blade pivot arm 70 which extends between blade 40 and the control area. When this is done, one of the cam portions 66 of projections 64 (depending upon the direction in which the operator moves blade pivot arm 70) cams against lock bar 76 and moves it out of engagement with projections 64 so that the angle of blade assembly 38 may be changed by pivoting it about pivot bolt 60. Stops 68 provided on blade support plate 58 on opposite sides of projections 64 positively engage lock bar 76 even when blade mount 22 and blade assembly 38 are in the raised position for limiting the angle through which blade assembly 38 may pivot. This prevents inadvertent contact of blade 40 with the tractor 10.

After the tractor operator has positioned the blade assembly 38 at the desired angle by manipulation of blade pivot arm 70, he again operates mount pivot arm 34 in order to move blade mount 22 and blade assembly 38 to the lowered position. As this occurs, lock bar link 80 and lock spring 82 urge and bias lock bar 76 back into positive engagement with projections 64 so that lock bar 76 again fits or nests within one of the slots defined by blade support plate 58 between projections 64 and stops 68. Blade assembly 38 is then positively locked and maintained at the newly selected angle, and the work operations may continue without the tractor operator ever having to leave the tractor control area.

Thus, an improved front blade mounting arrangement is disclosed which provides convenient angular repositioning of the blade assembly without the operator of the tractor to which the blade is mounted having to leave the control area. From the foregoing, it will be observed that numerous variations and modifications may be effected without departing from the true spirit and scope of the novel concept of the present invention. It will be understood that no limitation with respect to the specific apparatus illustrated is intended or should be inferred. It is, of course, intended to cover by the appended claims all such modifications that fall within the scope of the claims.

I claim:

1. A dozer blade mounting arrangement for a tractor, comprising:

a frame support adapted to be fixedly mounted on said tractor, a blade mount pivotally supported by said frame support for movement about a horizontal axis between raised and lowered positions, means for moving said blade mount between said raised and lowered positions, a blade assembly supported and movable with said blade mount, said blade assembly being pivotally connected to said blade mount for movement about a blade axis which is generally vertically disposed when said blade mount is in said lowered position, and blade lock means operatively connected with and extending between said blade mount and said frame support for preventing movement of said blade assembly about said blade axis when said blade mount is in the lowered position and allowing movement of said blade assembly about said blade axis only when said blade mount is in the raised position.

2. The dozer blade mounting arrangement of claim 1, wherein said blade lock means comprise lock bar means movably mounted on said blade mount movable into and substantially out of engagement with said blade assembly.

3. The dozer blade mounting arrangement of claim 2, wherein said blade lock means further comprise a link extending between and respectively connected with said lock bar means and said frame support so that movement of said blade mount between said lowered and raised positions moves said lock bar means out of and into engagement with said blade assembly.

4. A dozer blade mounting arrangement for a tractor, comprising:

a frame support adapted to be fixedly mounted on said tractor, a blade mount pivotally supported by said frame support for movement about a horizontal axis between raised and lowered positions, means for moving said blade mount between said raised and lowered positions, a blade assembly supported by and movable with said blade mount, said blade assembly being pivotally connected to said blade mount for movement about a blade axis which is generally vertically disposed when said blade mount is in said lowered position, and blade lock means for preventing movement of said blade assembly about said blade axis when said blade mount is in the lowered position and allowing movement of said blade assembly about said blade axis when said blade mount is in the raised position, said blade lock means comprising lock bar means movably mounted on said blade mount movable into and substantially out of engagement with said blade assembly, said blade lock means further comprising link means extending between and respectively connected with said lock bar means and said support frame whereby movement of said blade mount between said lowered and raised positions moves said lock bar means out of and into engagement with said blade assembly.

5. The dozer blade mounting arrangement of claim 4, wherein said blade lock means further comprise spring means for biasing said lock bar means toward engagement with said blade assembly.

6. The dozer blade mounting arrangement of claim 5, wherein said lock bar means comprise a lock bar pivotally connected intermediate its ends to said blade mount.

said link means being connected to one end of said lock bar and said spring means being connected to the other end of said lock bar.

7. The dozer blade mounting arrangement of claim 6, wherein said blade assembly includes a plurality of lock projections with which said lock bar means is engageable, said projections each including cam portions;

said lock bar means engaging said cam portions when said lock bar means is substantially out of engagement with said blade assembly to prevent said blade assembly from moving freely when said blade mount is in said raised position.

8. The dozer blade mounting arrangement of claim 7, and means for moving said blade assembly about said blade axis when said blade mount is in said raised position.

9. A dozer blade mounting arrangement for a tractor, comprising a frame support adapted to be fixedly mounted on said tractor, a blade mount pivotally supported by said frame support for movement about a generally horizontal axis, means for moving said blade mount about said horizontal axis between raised and lowered positions, a blade assembly supported by and movable with said blade mount, said blade assembly being pivotally connected to said blade mount for movement about a blade axis disposed generally vertically when said blade mount is in said lowered position, means for pivoting said blade assembly about said blade axis, and blade lock means for preventing pivotal movement of said blade assembly about said blade axis when said blade mount is in the lowered position and allowing movement of the blade assembly about said blade axis when said blade mount is in the raised position, said blade lock means comprising a lock bar pivotally connected to said blade mount for movement about a generally horizontal axis into and substantially out of engagement with a blade support plate of said blade assembly when said blade mount is moved between said lowered and raised positions, and link means extending between and connected with said lock bar and said frame support whereby said lock bar is moved substantially out of engagement with said support plate when said blade mount is moved to the raised position and said lock bar is moved into engagement with said support plate when said blade mount is moved into the lowered position.

10. The dozer blade mounting arrangement of claim 9, wherein said support plate includes projections which define slots in said support plate, said lock bar nesting within said slots and engaging at least one of said projection when said blade mount is in said lowered position, said projections each including cam portions engageable with said lock bar when said blade mount is in said raised position.

11. A dozer blade mounting arrangement for a tractor, comprising:

a frame support adapted to be fixedly mounted on said tractor, a blade mount pivotally supported by said frame support for movement about a horizontal axis between raised and lowered positions, means for moving said blade mount between said raised and lowered positions, a blade assembly supported by and movable with said blade mount, said blade assembly being pivotally connected to said blade mount for movement about a blade axis which is generally vertically disposed when said blade mount is in said lowered position, and blade lock means for preventing movement of said blade assembly about said blade axis when said blade mount is in the lowered position and allowing movement of said blade assembly about said blade axis when said blade mount is in the raised position, said blade lock means comprising lock bar means movably mounted on said blade mount movable into and substantially out of engagement with said blade assembly, said blade assembly including a plurality of lock projections with which said lock bar means is engageable, said projections each including cam portions;

said lock bar means engaging said cam portions when said lock bar means is substantially out of engagement with said blade assembly to prevent said blade assembly from moving freely when said blade mount is in said raised position.

12. The dozer blade mounting arrangement of claim 11 and means for moving said blade assembly about said blade axis when said blade mount is in said raised position.

* * * * *